US006776230B2

(12) United States Patent
Collie et al.

(10) Patent No.: US 6,776,230 B2
(45) Date of Patent: Aug. 17, 2004

(54) COILED TUBING LINE DEPLOYMENT SYSTEM

(75) Inventors: Graeme John Collie, Dunfermline (GB); David Ramsay Hutchison, Dunfermline (GB); Richard Kent, Newburgh (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/258,265

(22) PCT Filed: Apr. 17, 2001

(86) PCT No.: PCT/GB01/01738

§ 371 (c)(1),
(2), (4) Date: Oct. 21, 2002

(87) PCT Pub. No.: WO01/81711

PCT Pub. Date: Nov. 1, 2001

(65) Prior Publication Data

US 2003/0056956 A1 Mar. 27, 2003

(51) Int. Cl.[7] ..... E21B 29/12; E21B 19/00

(52) U.S. Cl. ..... 166/97.1; 166/337; 166/360; 166/75.13

(58) Field of Search ..... 166/337, 351, 166/360, 368, 97.1, 75.13

(56) References Cited

U.S. PATENT DOCUMENTS

| | | | | | |
|---|---|---|---|---|---|
| 3,662,822 | A | * | 5/1972 | Wakefield, Jr. | 166/335 |
| 3,954,137 | A | * | 5/1976 | Baugh | 166/351 |
| 4,625,798 | A | * | 12/1986 | Bayh, III | 166/106 |
| 4,903,774 | A | * | 2/1990 | Dykes et al. | 166/363 |
| 6,053,252 | A | | 4/2000 | Edwards | |
| 6,142,237 | A | | 11/2000 | Christmas et al. | |
| 6,152,230 | A | * | 11/2000 | Edwards et al. | 166/337 |
| 6,192,981 | B1 | * | 2/2001 | Boquet et al. | 166/75.13 |
| 6,345,668 | B1 | * | 2/2002 | Reilly | 166/332.2 |
| 6,591,913 | B2 | * | 7/2003 | Reaux et al. | 166/352 |

FOREIGN PATENT DOCUMENTS

| | | |
|---|---|---|
| EP | 0 572 732 A1 | 12/1993 |
| GB | 2 166 775 A | 5/1986 |
| GB | 2 311 312 A | 9/1997 |
| GB | 2 337 779 A | 12/1999 |
| GB | 2 337 780 A | 12/1999 |

OTHER PUBLICATIONS

Sangesland, "Electric Submersible Pump for Subsea Completed Wells," The Nordic Counsel of Ministers Program for Petroleum Technology, Nov. 26, 1991.
FMC Corporation, "FMC's Horizontal Subsea Trees" brochure, 1995.

* cited by examiner

*Primary Examiner*—Robert E. Pezzuto
*Assistant Examiner*—Thomas A Beach
(74) *Attorney, Agent, or Firm*—Henry C. Query, Jr.

(57) ABSTRACT

A horizontal Christmas tree is adapted for ESP/HSP or downhole sensor deployment by a coiled tubing hanger 38 received in the tubing hanger 12. Coiled tubing 40 suspends downhole equipment such as ESP 60, and carries power/signal lines. These lines are connected to an external line 58 via a transition connector 46 in a tubing access plug 44 provided in an internal tree cap 32. A debris cap 50 is provided with a further connector 52. Self orientating wet mate connectors 48, 54, 56 are provided between the connectors 46, 52 and external line 58. The coiled tubing hanger and/or tubing hanger may be provided with flow by flutes or holes (78, 80 FIGS. 4 and 5) sealable by a separate adapter plug (88, FIG. 5) above the coiled tubing hanger. Flow test procedures are also disclosed.

12 Claims, 4 Drawing Sheets

COILED TUBING LINE DEPLOYMENT SYSTEM

INVENTION BACKGROUND

Pressure drops in oil reservoirs have presented serious problems for operators. In the instance where reservoir pressure drops sufficiently to curtail all oil flow, electric or hydraulic submersible pumps (ESP/HSP) have been one method used to pump oil up the pipe. These pumps are dependent upon either an electrical or hydraulic cable or line. Similarly, data retrieval has been accomplished using electronic pressure/temperature sensors dependent upon either an electrical or fibre optic line.

Deployment of pumps, sensors and their associated electrical and hydraulic lines presents significant problems. Typically, two methods of ESP/HSP or data sensor deployment have been employed: tubing deployment and wireline deployment. Tubing deployment is heavy, bulky and time-consuming, requiring the cable or line to be secured to each tubing joint as it is added to the string. Wireline deployment is lighter and less time-consuming. However, wireline deployed ESP/HSP systems cannot be used in wells where a deviated bore is used, and the ESP/HSP can become stuck. Due to the environment in which it is operating, the life cycle of any equipment located in the tubing is short. This means retrieval and replacement on a regular basis, which is expensive and time-consuming, due to the fact that equipment can only be retrieved by pulling back the tubing. Certain wells which require artificial lift may prove to be non-viable using existing ESP/HSP deployment and servicing methods.

A third option is required whereby cable or line dependent equipment can be deployed and retrieved at minimal added cost to the operator. The means of deployment should ideally be applicable to both new and existing Christmas trees, in order to provide a more economically viable means of deploying or servicing artificial lift or sensor equipment.

SUMMARY OF THE INVENTION

The present invention provides a horizontal Christmas tree comprising a tubing hanger having a lateral production fluid outlet communicating with an axial through bore, the axial through bore being sealed above the lateral production outlet in use by a plug, the tubing hanger being landed in a substantially vertically extending bore in the christmas tree; an internal tree cap being installed within the vertically extending bore above the tubing hanger, characterised in that a coiled tubing hanger is landed within the tubing hanger and is adapted to suspend coiled tubing within the well, the coiled tubing carrying power or signal lines to downhole equipment, these power or signal lines exiting the tree upwardly through the cap. With such coiled tubing deployed cable dependent equipment, wells requiring artificial lift can be produced more economically than with other methods of artificial lift and ESP/HSP deployment, there being significant savings in time and equipment costs. The invention is particularly advantageous as the downhole power or signal lines and the pump or other equipment can be installed or replaced without disturbing the tree or tubing hanger.

The coiled tubing hanger may serve as the plug, for example replacing a crown plug previously installed in the tubing hanger through bore.

Preferably, an upper wireline plug of an otherwise standard horizontal Christmas tree is replaced with an access plug including power or signal lines running through it, allowing connection to the power and signal lines of the coiled tubing, without disturbing the tree cap. The invention may therefore be used to convert a former natural drive well for ESP/HSP operation, once its reservoir has lost pressure.

Further preferred features of the invention are in the dependent claims, and in the following description of illustrative embodiments, made with reference to the drawings in which:

Figure 4:
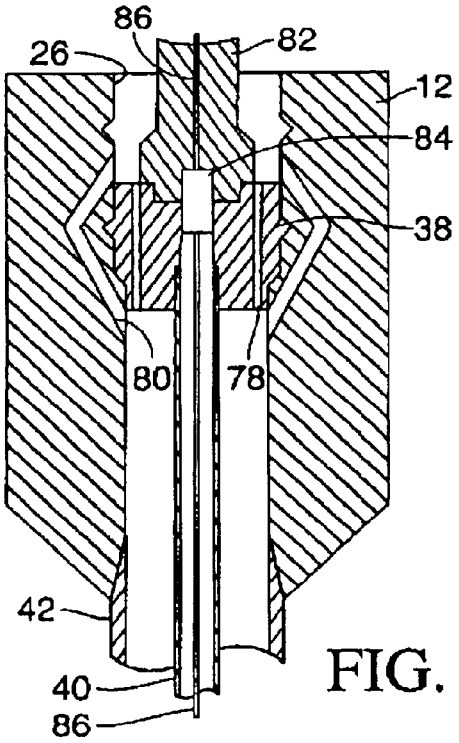
Figure 5:
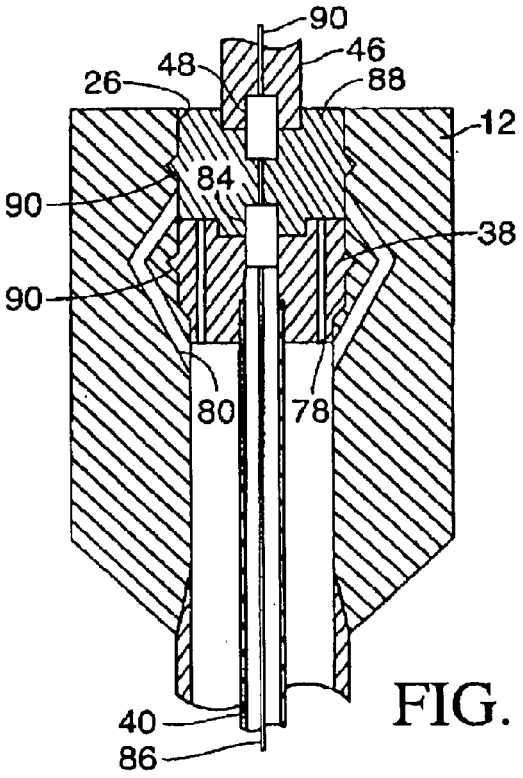
Figure 6:
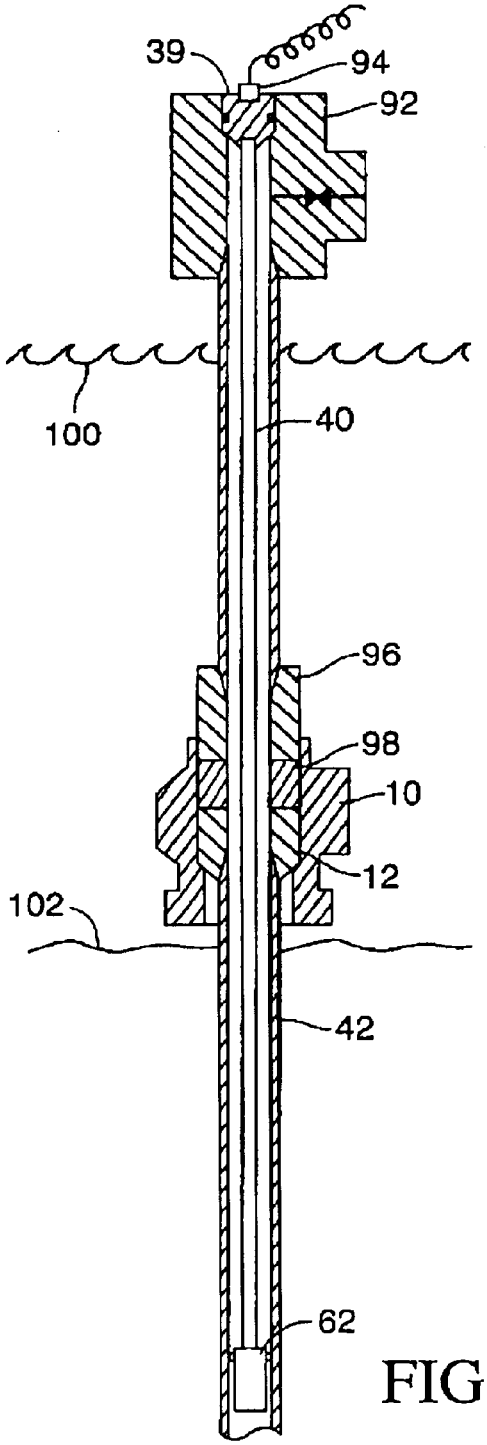

FIGS. 4 and 5 diagrammatically illustrate alternative embodiments of a tubing hanger and plug for use with the present invention; and FIG. 6 is a diagram of an alternative flow test method, using a, temporary pump.

Figure 1:
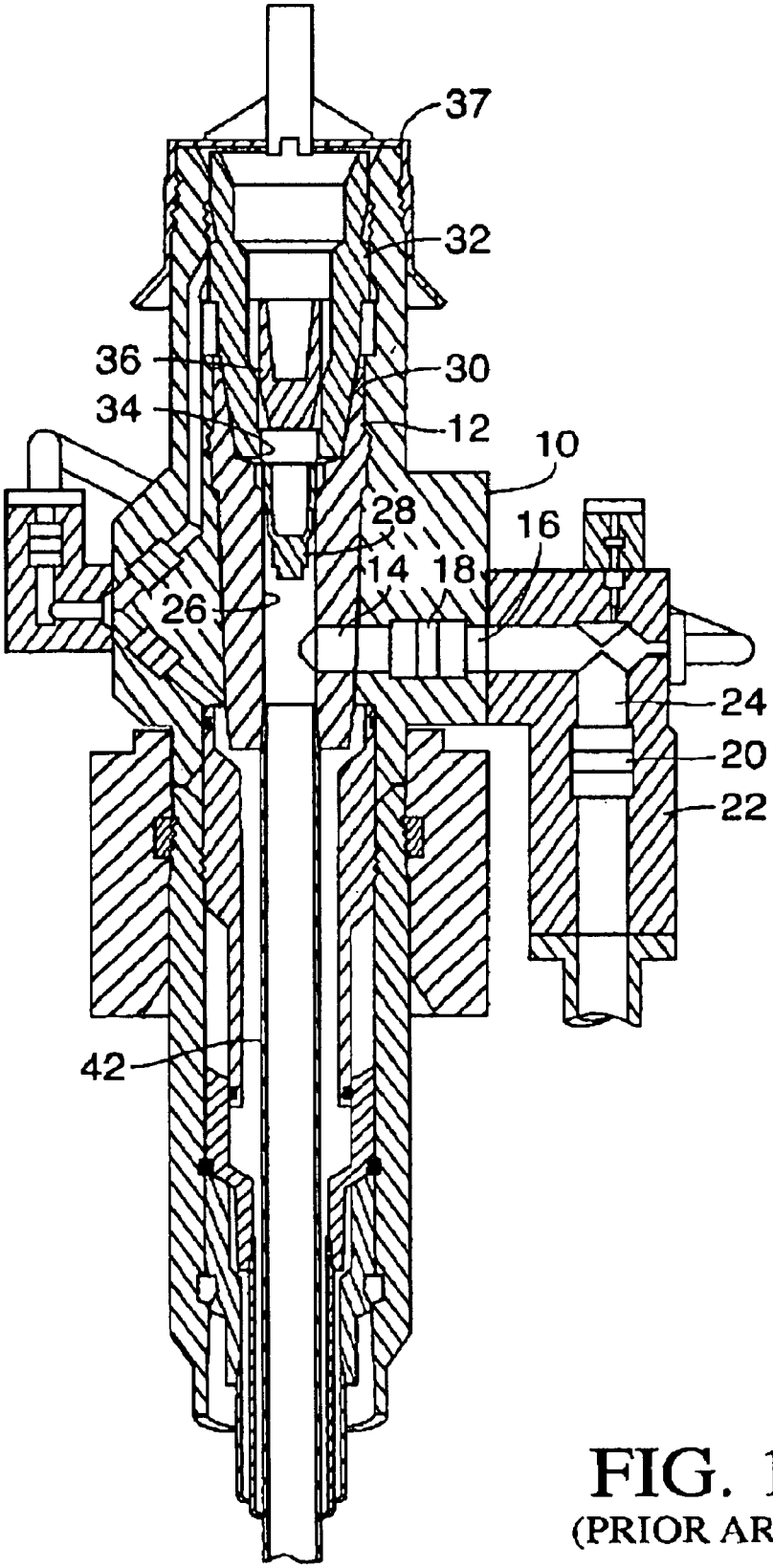
FIG. 1 (PRIOR ART)
FIG. 1 shows a known horizontal Christmas tree.

Referring to FIG. 1, a known horizontal Christmas tree 10 accommodates the tubing hanger 12. A lateral outlet 14 in the tubing hanger 12 communicates with a production fluid outlet passage 16 in the tree 10, equipped with a production master valve 18. A production wing valve 20 contained within a production wing block 22 is in fluid communication with the production master valve 18, via a passage 24.

A vertical through bore 26 in the tubing hanger 12 is sealed above the production fluid outlet passage 16 by a crown plug 28. The bore 30 in the Christmas tree 10 is sealed above the tubing hanger 12 by an internal tree cap 32. To permit wireline access to the tubing 42 using lightweight intervention equipment, the tree cap 32 includes a vertical through bore 34 sealed by an upper crown plug 36. A debris cap or "top hat" 37 is secured over the upper end of the tree 10.

Figure 2:
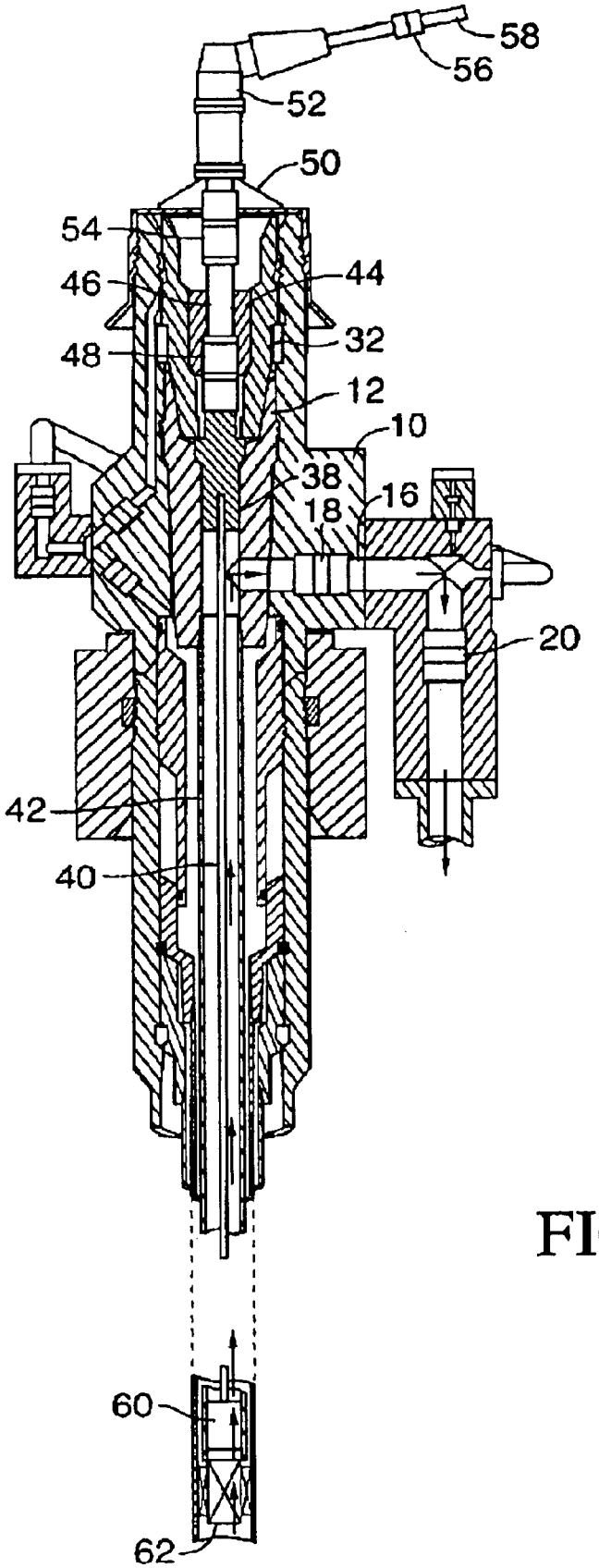
FIG. 2 shows an adaptation of the tree of FIG. 1 embodying the present invention.

Referring to FIG. 2, the following modifications are made in order to embody the present invention and provide for coiled tubing line deployment. A coiled tubing hanger 38 is provided in place of the crown plug 28, to suspend coiled tubing 40 within the tubing string 42. The upper wireline plug 44 is modified to include a transition connector 46 that supplies electrical/optical/hydraulic power or signals to the coiled tubing hanger 38. A self orientating wet mate connector 48 makes the electrical, optical or hydraulic connection between the transition connector 46 and the coiled tubing hanger 38. The top hat 50 is modified to include an electrical or hydraulic connector 52 that connects to the transition connector 46 via a self orientating wet mate connector 54. A further wet mate connector 56 is provided between the top hat connector 52 and an external power cable or signal line 58.

As shown, the interfaces between these components are non-orientating. The ESP/HSP/data retrieval equipment is run downhole to the required depth on the coiled tubing 40. The power/signal cable is run either down the tubing bore, down the annulus between the coiled tubing 40 and production tubing 42 ("coiled tubing annulus") or down the annulus surrounding the production tubing ("tubing annulus"). When the power/signal cables or lines are run down the coiled tubing bore or coiled tubing annulus, the cables or lines are routed through the coiled tubing hanger and tree cap, via the connectors shown. Cables or lines run down the production tubing annulus are routed through electrical/optical/hydraulic radial penetrators (not shown) extending through the wall of the tree into the tubing hanger 12, thereby facilitating hook up of the lines or cables below the tubing hanger.

When the ESP/HSP/data retrieval equipment is at the required depth, it is locked into the tubing, and the coiled tubing installation string is removed. FIG. 2 illustrates an electrical submersible pump 60 landed and sealed within the tubing 40 lower end. By this means, production fluid is pumped up the annulus between the coiled tubing 40 and the production tubing 42, out through the production master valve 18 and wing valve 20. A surface controlled subsea safety valve (S. C. S. S. V.) 62 is included in the completion below the pump 60. Production fluid flow is represented by the arrows shown in FIG. 2.

If desired, additional downhole hydraulic and electrical lines may be incorporated in the system to provide communication to the other downhole equipment items such as the S. C. S. S. V, or temperature and pressure gauges. The lines are connected in a similar manner to the power and signal connections described above.

The system described above has self orienting wet mate connectors 48, 54, 56. In the circumstance that a connection system is used that has a large number of parallel electrical/hydraulic/optical connections, it may be preferable to use an orientated system. That is, the transition connector 46, tree cap 32, upper wireline plug 44 and coiled tubing hanger 38 are all aligned as required to make up the connections. The alignment is provided by means of keyways, orientation pins or orientation helices.

Figure 3:
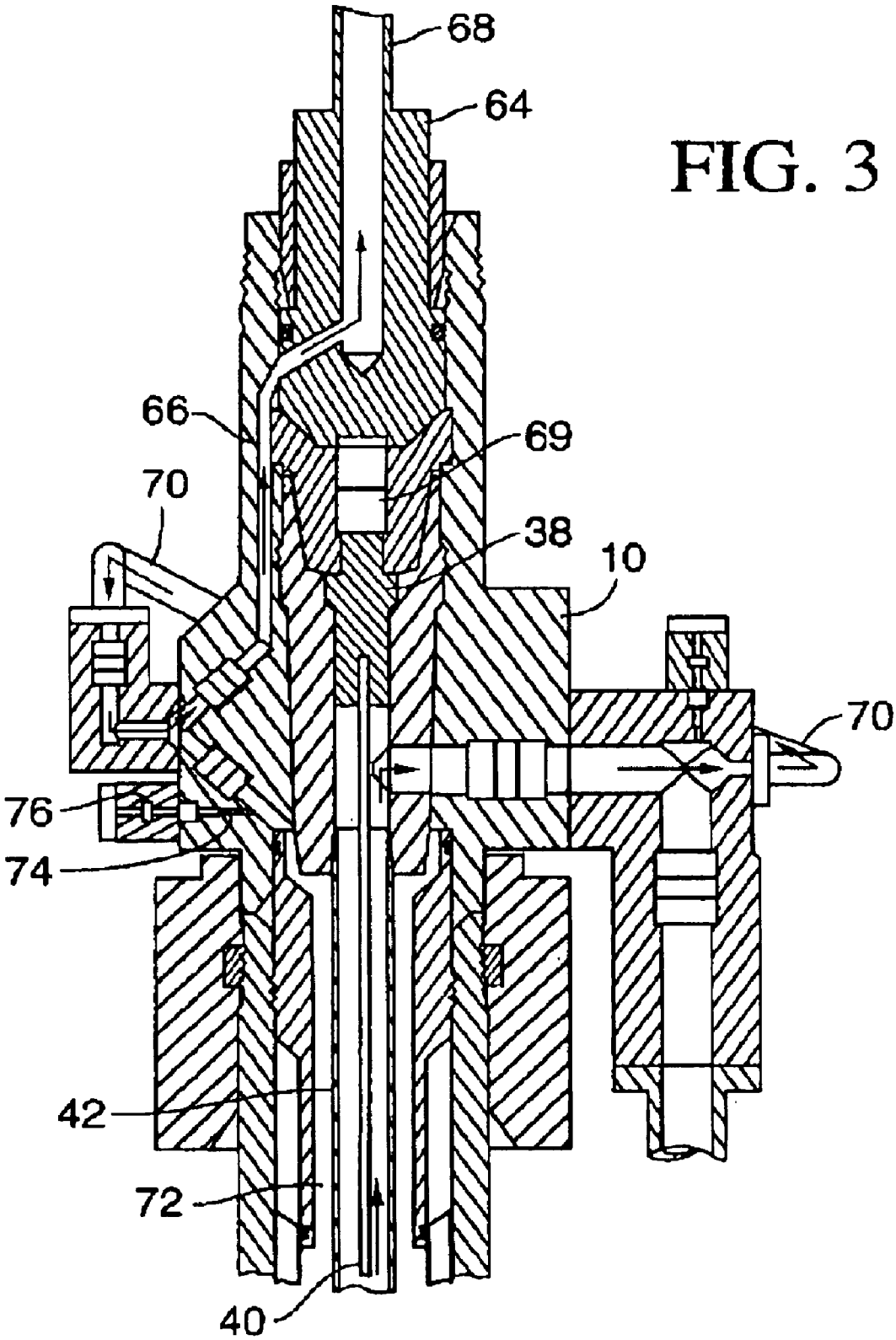
FIG. 3 shows the tree of FIG. 2 undergoing a flow test.

There may be a requirement to flow test the well vertically prior to production via the horizontal tree side outlet 16. In this circumstance, an intervention test tool 64 may be used as shown in FIG. 3. The tool 64 locks to the bore of the tree 10 and seals above the upper annulus outlet 66. Flow test to an intervention riser 68 and surface test equipment is provided via the crossover flow loop 70 on the tree. During the flow test, the annulus 72 between the production tubing 42 and production casing is vented via a separate line 74 that is controlled by a valve 76. Tis is required due to thermal expansion of the annulus fluids. If an emergency vessel drive off situation occurs during the flow test, the valves on the subsea tree may be closed to isolate the well and the intervention test tool 64 may be disconnected. The advantage of this is that no subsea test tree equipment is needed in the intervention string during the flow test. The arrows in FIG. 3 represent fluid circulation during the test. Electrical/hydraulic/fibre optic connections are made between the coiled tubing hanger 38 and corresponding lines in the test tool 64 via an intermediate connector 69.

In an alternative embodiment diagrammatically shown in FIGS. 4 and 5, the coiled tubing hanger 38 landed in the tubing hanger 12 has flutes or holes 78, to allow flow by of fluids in the production bore during the test. Alternatively, flow by flutes or holes 80 may be provided at the tubing hanger inside diameter. After the test is complete, the coiled tubing installation string is recovered by disconnecting a dedicated running tool 82 that is locked to the coiled tubing hanger 38 and provides power communication via a wet mate connector 84 and power lines 86. The coiled tubing hanger 38 is left in place in the tubing hanger 12 as shown in FIG. 5. An adapter plug 88 is then installed above the coiled tubing hanger 38 to seal off the production bore 26. The adapter plug 88 locks and seals to the bore of the tubing hanger 12 above the coiled tubing hanger 38 and communicates the power cables 86 between the transition and wet mate connectors 46, 48 and the wet mate connector 84 of the coiled tubing hanger 38. Locking and sealing profiles are diagrammatically indicated at 90. It will be seen that when in place, the adapter plug seals the flow by flutes or holes 78, 80, thereby sealing the tubing hanger through bore 26. Alternatively, the adapter plug seals to the bore of the tubing hanger 12 and locks to the coiled tubing hanger 38 using the same lock interface as the running tool 82.

As a further alternative, it may be preferable to flow test the well using a pump 62 that is temporarily suspended from the surface. (See FIG. 6). Where present, the coiled tubing hanger 38 is retrieved from the tubing hanger 12. Coiled tubing 40 is suspended at a surface test tree 92 and dry power connections 94 are made up to the surface tree coiled tubing hanger 39. A subsea test tree 96 may be provided in the intervention string above the tubing hanger ring tool 98, to enable subsea isolation and disconnection from the well. The advantage of this is that if at start up there are problems encountered in the lower completion section below the pump 62, then the test equipment can be easily retrieved and remedial downhole operations performed prior to re-commencement of the flow test. In FIG. 6, 100 represents sea level and 102 the mudline.

The invention allows for the economic development of low pressure fields using standard wellheads and Christmas trees fitted with a coiled tubing deployed ESP's or HSP's, as well as the rapid and economical servicing of ESP's, HSP's, downhole sensors and similar cable connected equipment.

What is claimed is:

1. A horizontal Christmas tree comprising:

a substantially vertically extending bore;

a tubing hanger landed within the bore and having a lateral production fluid outlet communicating with an axial through bore;

a coiled tubing hanger landed within the tubing hanger and adapted to suspend coiled tubing within a well over which the tree is installed;

the coiled tubing carrying power or signal lines to downhole equipment; and an internal tree cap installed within the vertically extending bore above the tubing hanger;

wherein the axial through bore is sealed above the lateral production fluid outlet in use by a plug; and wherein the power or signal lines exit the tree upwardly through the internal tree cap.

2. A horizontal Christmas tree as defined in claim 1, characterised in that the coiled tubing hanger comprises the plug.

3. A horizontal Christmas tree as defined in claim 2, characterised in that the coiled tubing hanger is installed in the tubing hanger in place of a crown plug.

4. A horizontal Christmas tree as defined in claim 1, characterised in that an adapter plug is provided in the tubing hanger axial through bore above the coiled tubing hanger, and the tubing hanger and/or the coiled tubing hanger are provided with fluid passages which are sealed by the adapter plug.

5. A horizontal Christmas tree as defined in claim 1, characterised in that the internal tree cap includes a tubing access plug and the power or signal lines extend through the tubing access plug and the coiled tubing hanger.

6. A horizontal Christmas tree as defined in claim 5, characterised in that the power or signal lines carried by the coiled tubing are connected to an external line via a first wet mate connector which is connected between the coiled tubing hanger and a transition connector in the tubing access plug.

7. A horizontal Christmas tree as defined in claim 6, characterised in that a second wet mate connector is connected between the transition connector and a third connector provided in a debris cap or top hat at the upper end of the Christmas tree.

8. A horizontal Christmas tree as defined in claim 7, characterised in that the third connector is connected to the external line by a fourth wet mate connector.

9. A horizontal Christmas tree as defined in claim 5, characterised in that the tubing access plug is installed in the internal tree cap in place of an upper wireline plug.

10. A horizontal Christmas tree as defined in claim 6, characterised in that the first wet mate connector is self orientating.

11. A method of flow testing a horizontal Christmas tree as defined in claim 1, characterised in that the coiled tubing hanger is removed and flow test equipment is suspended in the well through the through bore and an intervention riser using coiled tubing suspended from a surface tree.

12. A test method as defined in claim 11, characterised in that power or signal lines are carried by the coiled tubing suspended from the surface tree.

* * * * *